US006434820B1

(12) United States Patent
Volstorf

(10) Patent No.: US 6,434,820 B1
(45) **Date of Patent: *Aug. 20, 2002**

(54) METHOD OF MANUFACTURING INSULATION DISPLACEMENT CONTACT DIMPLE

(75) Inventor: James R. Volstorf, Mechanicsburg, PA (US)

(73) Assignee: FCI Americas Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/412,179

(22) Filed: Oct. 5, 1999

Related U.S. Application Data

(63) Continuation-in-part of application No. 08/580,761, filed on Dec. 29, 1995, now abandoned, and a division of application No. 08/315,440, filed on Sep. 30, 1994, now abandoned.

(51) Int. Cl.[7] ..... H01R 43/04
(52) U.S. Cl. ..... 29/874; 29/882; 29/753
(58) Field of Search ..... 29/753, 866, 874, 29/882

(56) References Cited

U.S. PATENT DOCUMENTS

| | | | | |
|---|---|---|---|---|
| 3,867,005 A | | 2/1975 | Hoppe | |
| 3,926,498 A | | 12/1975 | Hoppe | |
| 4,018,177 A | | 4/1977 | McKee | 113/119 |
| 4,027,521 A | | 6/1977 | McKee | 72/404 |
| 4,035,049 A | | 7/1977 | McKee | |
| 4,040,702 A | | 8/1977 | McKee | |
| 4,050,760 A | | 9/1977 | Cohen | |
| 4,208,083 A | | 6/1980 | Kirby | |
| 4,208,084 A | | 6/1980 | Kali | |
| 4,385,794 A | | 5/1983 | Lucius | 439/399 |
| 6,012,942 A | * | 1/2000 | Volstorf | |
| 6,021,568 A | * | 2/2000 | Volstorf | |

FOREIGN PATENT DOCUMENTS

| | | | | |
|---|---|---|---|---|
| GB | 2 059 307 | * | 4/1981 | 29/866 |

* cited by examiner

*Primary Examiner*—Carl J. Arbes
(74) *Attorney, Agent, or Firm*—M. Richard Page; Steven M. Reiss

(57) ABSTRACT

Disclosed is a method for manufacturing an insulation displacement contact dimple comprising the steps of. (a) positioning a metal element between a first concave upper die and a first convex lower die having a radius to form a dimple shape in the medial element; (b) positioning the dimple shaped metal element formed in step (a) between a second concave upper die and second convex lower die having a radius smaller than the radius of the first convex lower die to reform the dimple shaped metal element formed in step (a); and (c) positioning the dimple shaped metal element formed in step (b) between a third concave upper die and a third convex lower die having a radius larger than the radius of the second convex lower die. A contact dimple manufactured by the method is also disclosed.

28 Claims, 13 Drawing Sheets

METHOD OF MANUFACTURING INSULATION DISPLACEMENT CONTACT DIMPLE

CROSS REFERENCE TO RELATED APPLICATIONS

This is a continuation-in-part of application Ser. No. 08/580,761 filed Dec. 29, 1995, now abandoned, a division of Ser. No. 08/315,440 filed Sep. 30, 1994, abandoned.

BACKGROUND OF THE INVENTION

1. Field of the Invention

The present invention relates to electrical connectors and more particularly to insulation displacement contact terminals.

2. Brief Description of Prior Developments

In order to further miniaturize various electronic systems, insulation displacement contact terminals have been substituted for soldered connections in a number of applications. Such terminals are disclosed, for example, in U.S. Pat. Nos. 4,050,760 and 4,385,794. In such terminals, insulated wires to be connected are inserted into contact channels having opposed transverse projections known as dimples. These dimples remove insulation from the wires so inserted to allow electrical connection between these wires and the terminal. Heretofore these contact dimples have been formed by a process of inwardly shearing the side walls of the contact channels.

The effectiveness of the connection with those contact dimples is dependent, at least in part, on the amount of pressure applied to connected wires by the contact dimples. A continuing need, therefore, exists for means by which pressure applied by such dimples on the connecting wire can be increased.

SUMMARY OF THE INVENTION

It has been found that the amount of pressure which may be applied to inserted wires is advantageously affected by a number of factors including the stiffness or spring rate of the contact channel, the channel yield strength and the sharpness of the front face of the dimples. It has also been found that the shearing process for forming these dimples may adversely affect these factors. In the method of the present invention the contact dimples are formed in a compressive operation in which a compressive force is inwardly exerted on a metal blank after which the metal is formed into a contact channel. For the purpose of this disclosure a compressive operation will be considered to be any metal forming operation including sizing, swaging, coining and extruding in which a metal blank or slug is squeezed to thereby change its form through the direct application of compressive force. The metal strained in this way by compressive stresses is plastically deformed and behaves like a viscous liquid. Preferably the method of the present invention will be carried out by swaging and preferably in a series of successive steps.

In the present invention insulation displacement contact dimples are preferably produced in a punch press in three general steps. In the first step, a metal strip stock element is positioned between a first concave upper die and a first convex lower die. In this step the metal is not only stretched, but is swaged along the side of the dimple shaped element. An upper cavity is formed between the dimple shaped element and the first upper die and the metal is extruded upwardly toward that upper cavity. In the second step, the dimple shaped element is positioned between a second concave upper die and a second convex lower die. This lower die has a radius that is smaller than the radius of the first convex lower die used in the first step. Thus, the height of the dimple is raised. In this second step swaging also occurs on the side of the dimple but at a greater height than on the first step. In a third step, the dimple shaped element is positioned between still another third concave upper die and a third convex lower die. This third convex lower die has a greater radius and a steeper slope than the second convex lower die. In this step a lower cavity is initially formed between the dimple shaped element and the third convex die and an upper cavity between the dimple shaped element and the third concave die. The dies press against the dimple shaped element at points between these upper and lower cavities and begin to swage the metal. The forces involved are such that the metal will flow into the upper cavity first and then once the upper cavity is filled will flow into the lower cavity. The two cavities are needed since the metal at the top and bottom of the dimple shaped element will be thinner than the metal in the middle. The lower cavity allows the extra metal in the middle to flow into it while the upper cavity is still being filled near the top and bottom of the dimple. The process is also capable of flowing the metal into the upper die into a radius that is smaller than the thickness of metal. Alternatively, the third step may involve filling the lower end of the dimple shaped element by thinning the metal at the lower end and extruding the metal upwardly. The method produces a sharp dimple with a small radius on the front face that efficiently pierces wire insulation and extrudes into the copper conductor. In many cases the first, second and third upper dies will be identical and the same upper die can be used for all three steps.

BRIEF DESCRIPTION OF THE DRAWINGS

The invention is further described with reference to the accompanying drawings in which.

DETAILED DESCRIPTION OF THE PREFERRED EMBODIMENT

Figure 1:
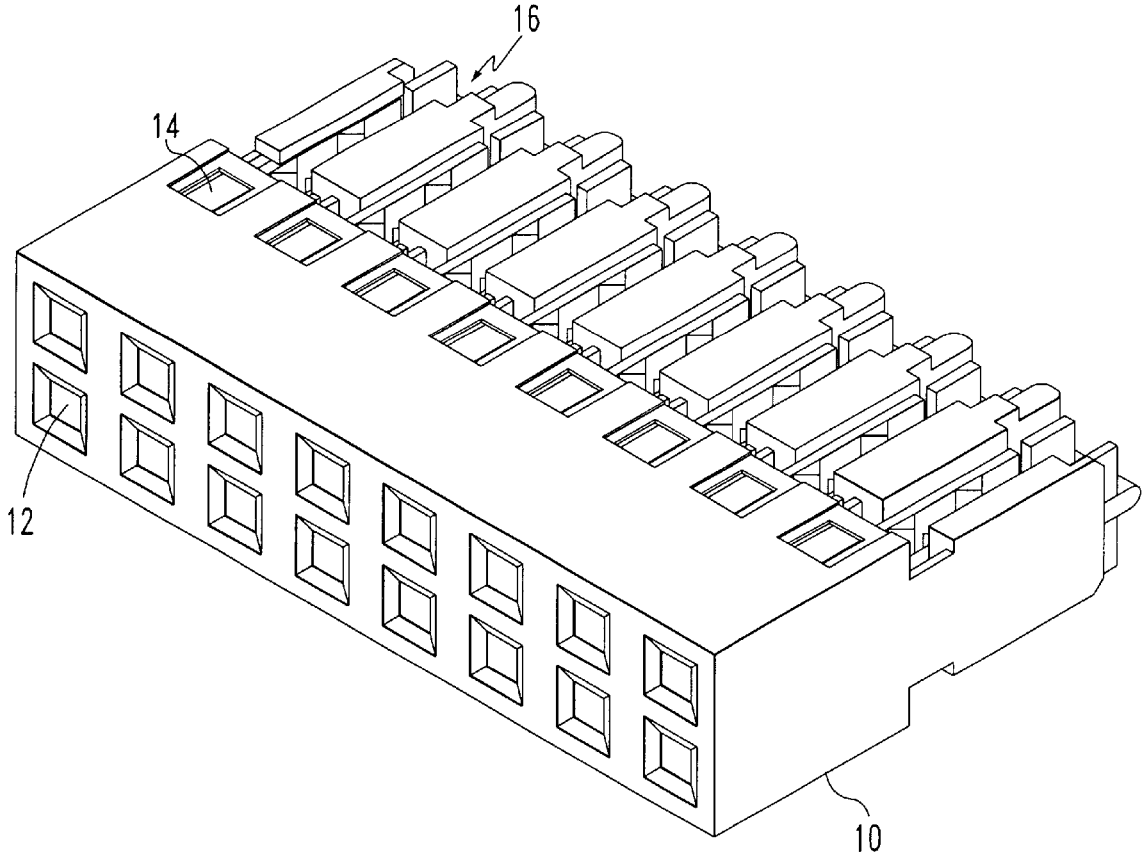
FIG. 1 is a perspective view of a preferred embodiment of the insulation displacement contact terminal of the present invention.
Figure 2:
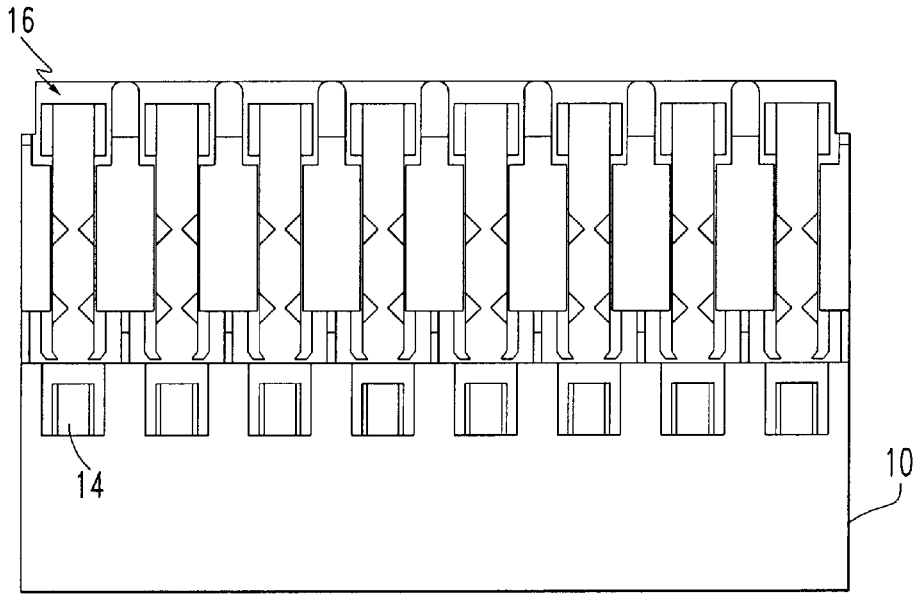
FIG. 2 is a top plan view of the terminal shown in FIG. 1.
Figure 3:
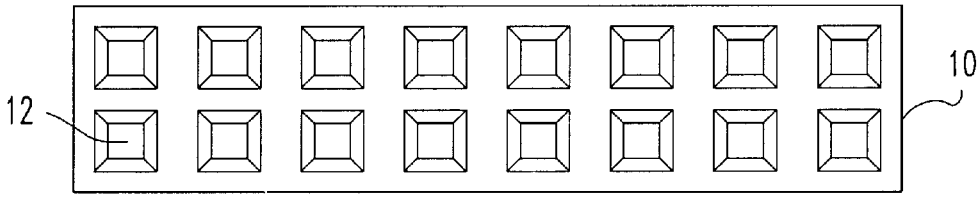
FIG. 3 is a front elevational view of the terminal shown in FIG. 1.
Figure 4:
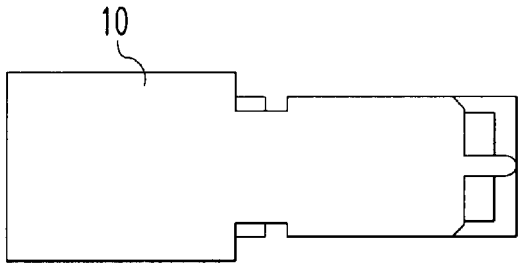
FIG. 4 is a side elevational view of the terminal shown in FIG. 1.

Referring to FIGS. 1 through 3 the insulation displacement contact cable connector of the present invention has an insulated body 10 which may preferably be a flame retardant GFR nylon. On its front side it has two rows of ten pin receiving apertures as at 12 and latching apertures as at 14 and a plurality of contacts as at 16.

Figure 5:
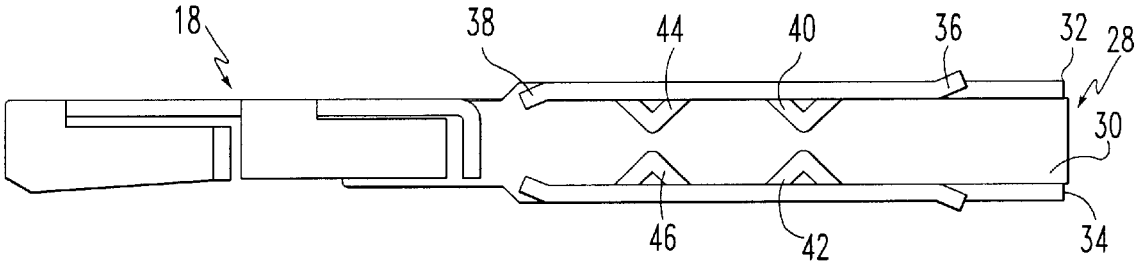
FIG. 5 is a top plan view of an individual channel in the terminal shown in FIG. 1.
Figure 6:
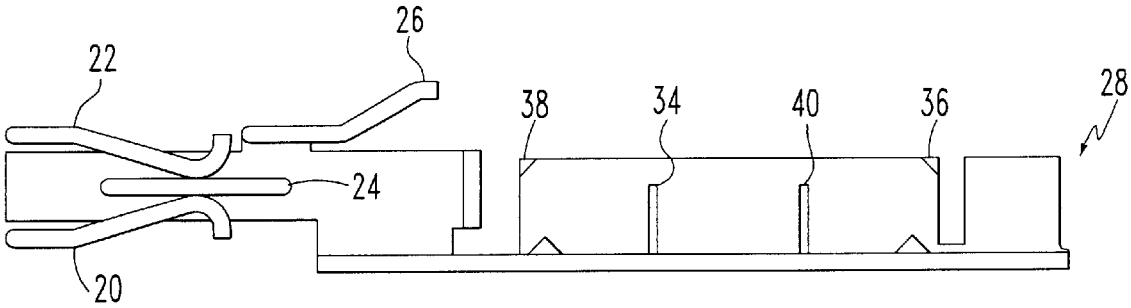
FIG. 6 is a vertical cross sectional view of the channel shown in FIG. 5.
Figure 7:
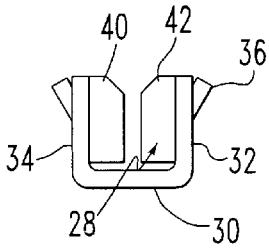
FIG. 7 is an end view of the channel shown in FIG. 5.

Referring to FIGS. 5 through 6 the terminals include an intermediate conductor engaging portion generally at numeral 18 which includes tines 20 and 22 which engage a pin (not shown) in an array of pins on a circuit board, a stiffening rib 24 and a latching finger 26 which engages the terminal. The terminal also includes a forward wire engaging portion generally at numeral 28 which includes a terminal for 30 and sidewalls 32 and 34. In these sidewalls there are centering flares as at 36 and lead in flares as at 38. On the inner side of the sidewalls there are opposed contact dimples 40 and 42. Longitudinally inward from these dimples there is another set of contact dimples 44 and 46.

Figure 8:
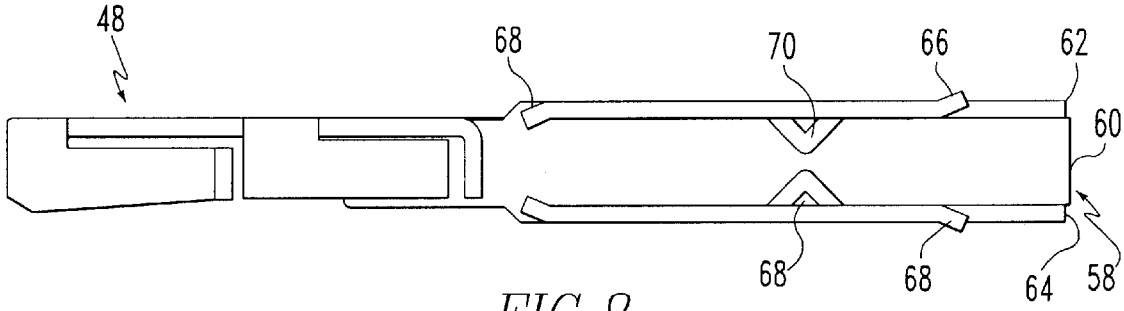
FIG. 8 is an alternate embodiment of the channel shown in FIG. 5.
Figure 9:
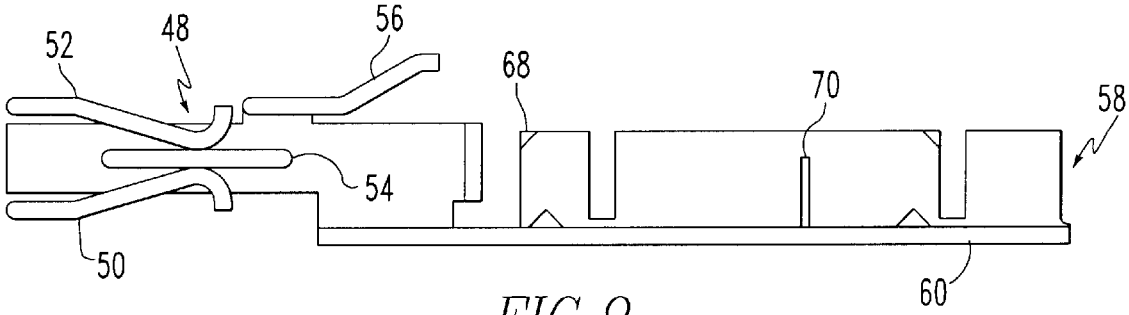
FIG. 9 is a vertical cross sectional view of the channel shown in FIG. 8.
Figure 10:
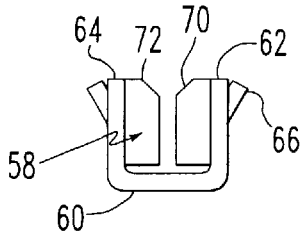
FIG. 10 is an end view of the channel shown in FIG. 8.

Referring to FIGS. 8 through 10, there is shown terminals having only a single set of contact dimples per channel which include an intermediate conductor engaging portion shown generally at numeral 48 which includes tines 50 and 52, stiffening rib 24 and latching finger 56.

The terminal also includes a forward wire engaging portion generally at numeral 58 which includes a channel floor 60 and sidewalls 62 and 64. In these sidewalls there are wire strain relief flaps as at 66 and 68. On the inner side of the sidewalls there is a single pair of opposed contact dimples 70 and 72.

Figure 13:
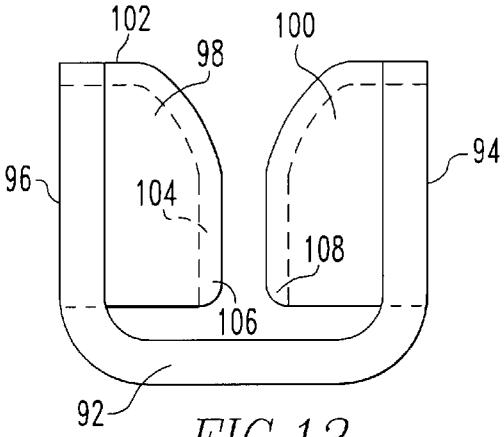
FIG.13 PRIOR ART
FIG. 13 is a schematic end view of a prior art dimple.
Figure 11:
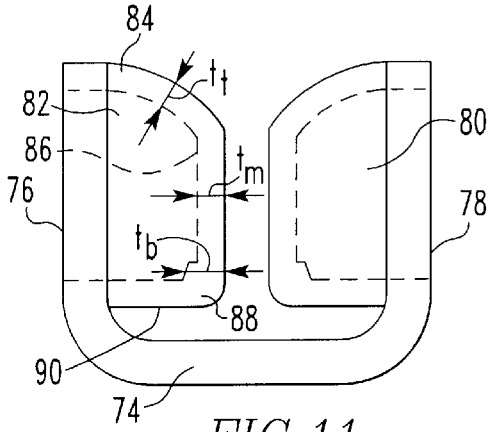
FIG. 11 is a schematic view of an end view of the dimple of the present invention.
Figure 14:
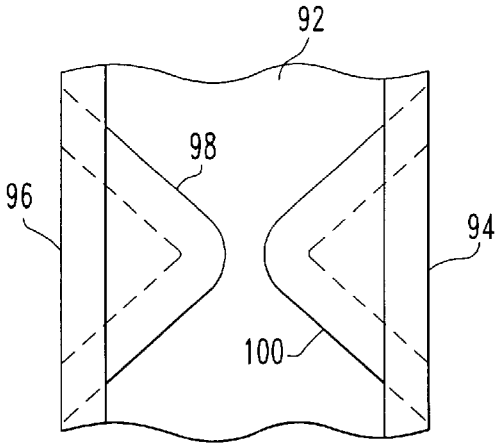
FIG.14 PRIOR ART
FIG. 14 is a schematic top plan view of a prior art dimple.
Figure 12:
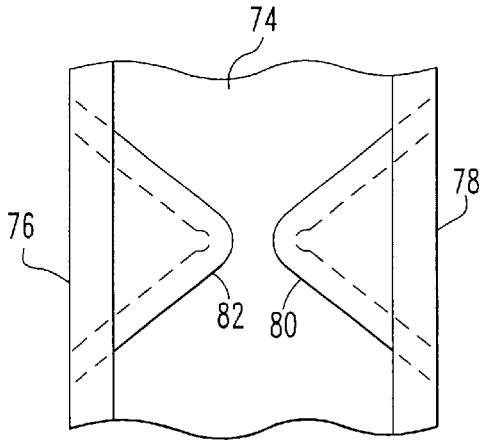
FIG. 12 is a schematic top plan view of the dimple shown in FIG. 11.

Referring to FIGS. 11 and 12, there is shown a contact channel with channel floor 74 and sidewalls 76 and 78. Contact dimples 80 and 82 extend from these sidewalls. Each of these contact dimples has a top cover section as at 84, a medial section as at 86 and a bottom section as at 88. A lower floor section 90 extends from the sidewalls to contact the bottom section. The top section has a thickness $t_t$ which is preferably in the range of 0.002" to 0.008", the medial section has a thickness $t_m$ which is preferably in the range of 0.002" to 0.008" and the bottom section has a thickness $t_b$ which is preferably in the range of 0.002" to 0.008". Referring to FIGS. 13 and 14, in the prior art channel there is likewise a channel floor 92 and sidewalls 94 and 96 from which contact dimples 98 and 100 extend. These prior art contact dimples have a top arm section 102, a medial section 104 and a bottom section 106 but do not have a lower arm section as is shown at numeral 90 in FIG. 11.

Figure 15:
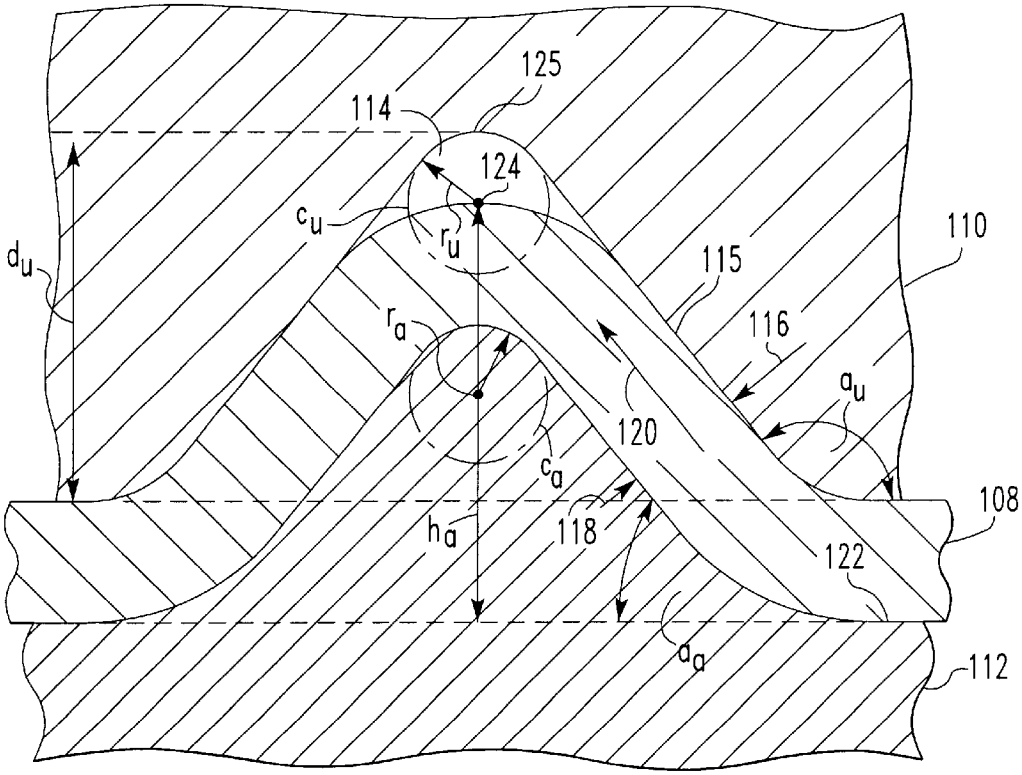
FIGS. 15 through 18 are sequential schematic illustrations taken through the transverse axes of a strip stock metal element position between an upper and a lower die illustrating steps in the method of the present invention.
Figure 16:
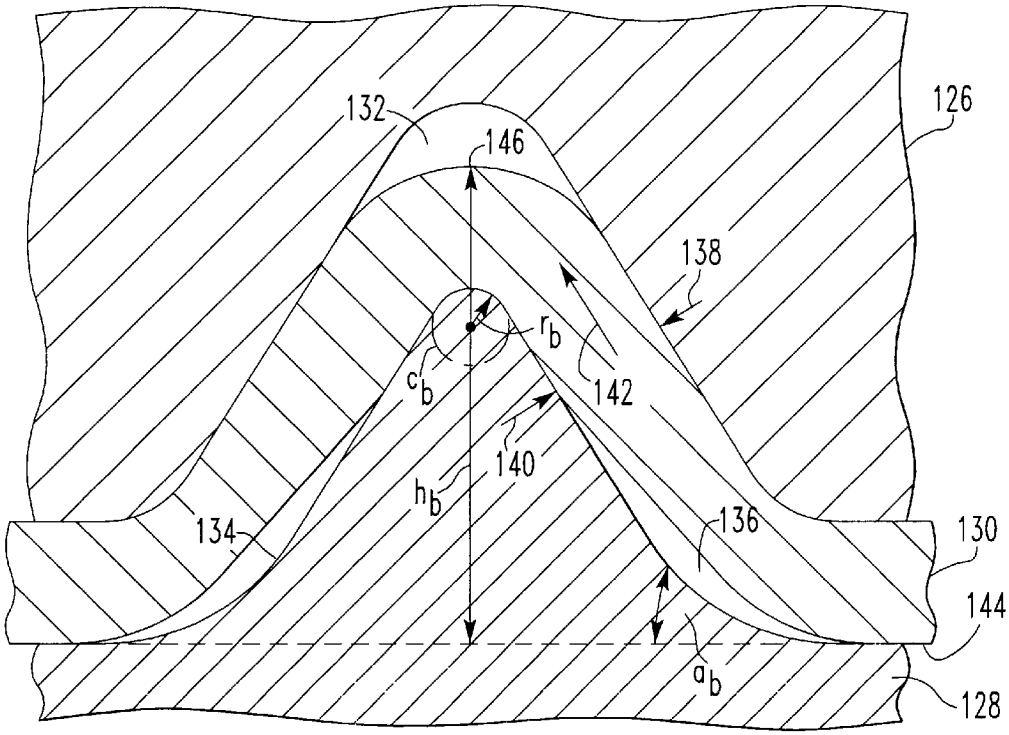
Figure 17:
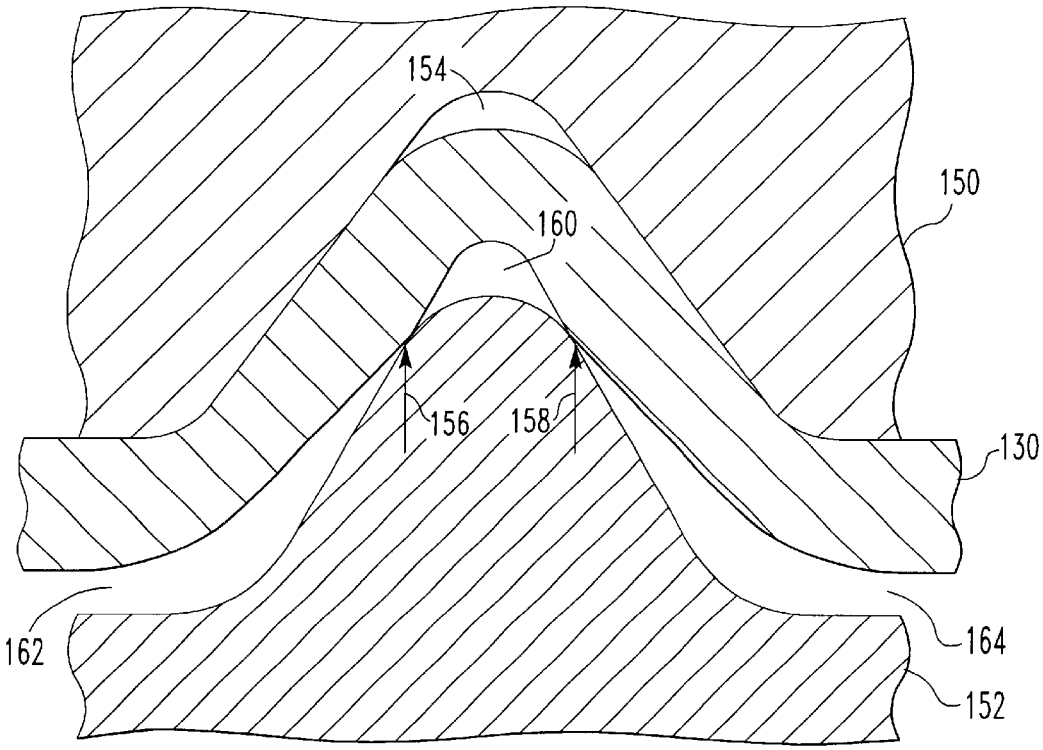
Figure 18:
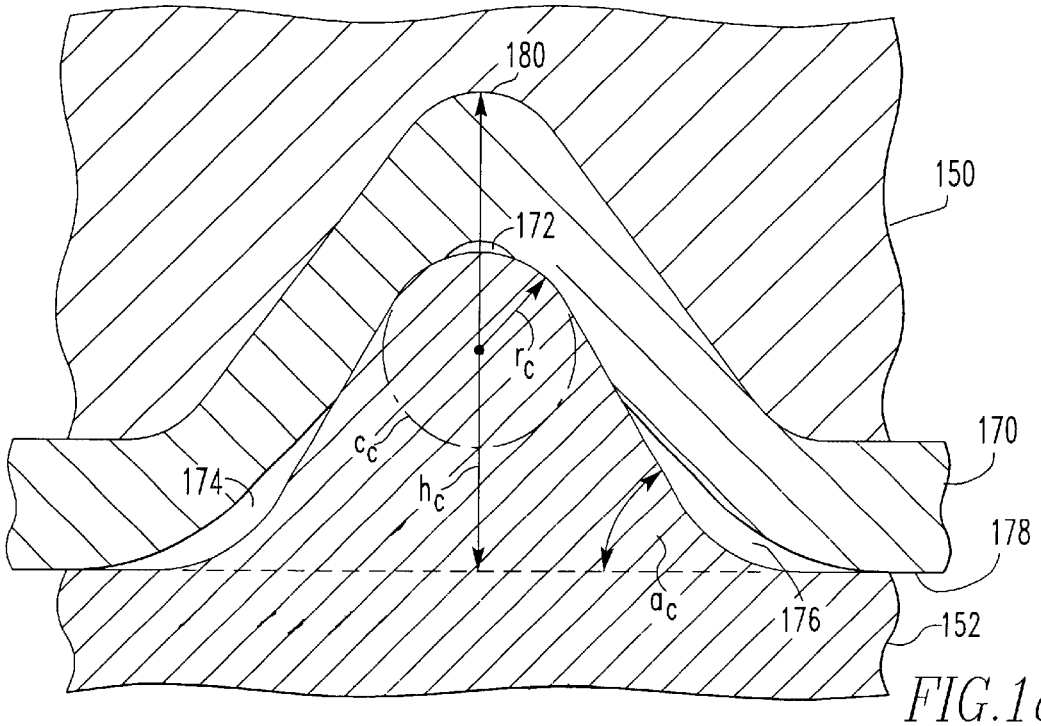
Figure 19:
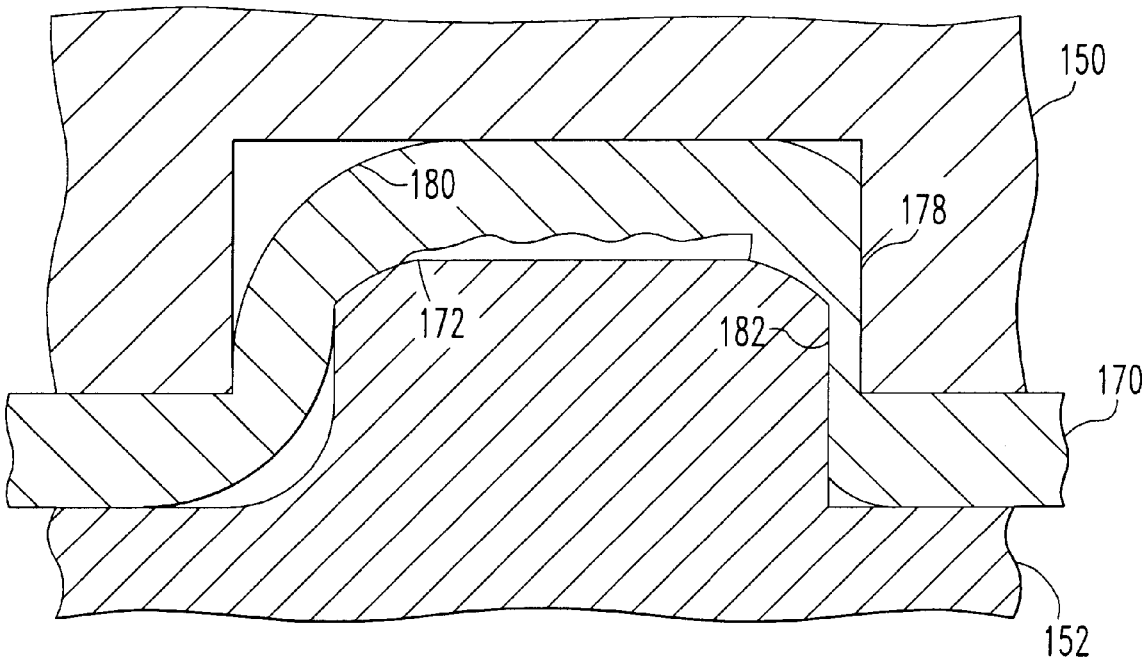
FIG. 19 is a longitudinal cross sectional view of a metal element position between an upper, lower die showing another step in the method of the present invention.

Referring to FIGS. 15 through 19, the method of manufacturing the contact dimple of the present invention is illustrated. Referring particularly to FIG. 15 the first step in the method of the present invention is illustrated. A metal element 108 is positioned between a first upper die 110 and a first lower die 112 and the punch press is activated until the position as shown in FIG. 15 is achieved such that a first upper cavity 114 is formed. During this step compressive and preferably swaging force is applied to the side as at 15 of the now dimple shaped metal element as at arrows 116 and 118 and metal in the metal element is caused to be extruded or otherwise flow in the direction of the upper cavity as at arrow 120. It will also be observed that the metal element has a base 112 and an apex 124 and the difference between these points define a height $h_a$. The first lower die also has a slope defined by angle $a_a$. It will also be observed that the lower die has a radius $r_a$ which is the radius of the circle $c_a$ which has a curve coinciding with the lower die at its apex. It will also be noted from FIG. 15 that the upper die has a depth $d_u$ and a radius $r_u$ which is the radius of a circle as at $c_u$ which coincides with its curve at its deepest point 125. It will also be noted that the upper die has a slope defined by angle $a_u$ between its side and base. After the completion of the first step, the metal element is removed from between the first and second die and positioned between two other dies or alternatively between the first upper die and a second lower die. FIG. 16 shows the metal element at the completion of this second step in which there is a second upper die 126, a second lower die 128 and the reformed metal element 130. Between the upper die and the metal element is a second upper cavity 132 between the reformed metal element and the second lower die there are also lateral cavities 134 and 136. Above these lateral cavities compressive and preferably swaging forces are applied to the side of the reformed metal element as at arrows 138 and 140 so as to cause the element to be extruded or otherwise flow toward the second upper cavity as in the direction of arrow 142. The metal element has a base 144 and an apex 146 and a difference in height between these points is $h_b$. There is also a radius $r_b$ on the second lower die which is the radius of the circle $c_b$ coinciding with the curve of the apex. On completion of the second step, the metal element is removed from between the second upper die and the second lower die and placed between two other dies or alternatively the same upper die will be used. The beginning of this step is illustrated in FIG. 17 in which the reformed metal element 130 removed from the end of the second step is inserted between a third upper die 150 and third lower die 152. A third upper cavity 154 is formed between the metal element and the third upper die, and there are contact points as at 156 and 158 where the third lower die bears against the metal element to form a second lower cavity 160 and lateral access spaces as at 162 and 164. Referring to FIG. 18 the relative positions of the elements shown in FIG. 17 at the end of the third step are illustrated in which between the upper die 150 and the lower die 152 there is interposed the reformed metal element 170. There is a reformed third lower cavity 172 between the third lower die and the metal element and lateral cavities 174 and 176 also positioned between the metal element and the third lower die. The dimple base is shown at 178 and its apex or top at 180. Between the base 178, prime and the top of the metal element there is a height $h_c$. There is also a radius of the circle coinciding with the curve of the apex of the third lower die $r_c$ wherein that circle is shown at $c_c$. Also shown is the angle between the base of the metal element and the slope of the side of the third lower die $a_c$. Referring particularly to FIG. 19, it will be seen that the metal is thinned by forcing it through neck 182.

Preferably the heights of the lower dies and the depths of the upper dies will be in the range of 0.013" to 0.021". The radius of the upper dies will be in the range of 0.002" to 0.020" but normally not more than the thickness of the metal element. The radius of the first lower die will preferably be in the range of 0.003" to 0.005", the second lower die will be in the range of 0.004" to 0.006" and the third lower die will be in the range of 0.010" to 0.015". The slope of the upper dies will preferably be in the range of 20° to 80°. The slope of the first lower die will preferably be in the range of 30° to 40°, the second lower die will be 40° to 50° and the third lower die will be 50° to 60°.

Figure 20:
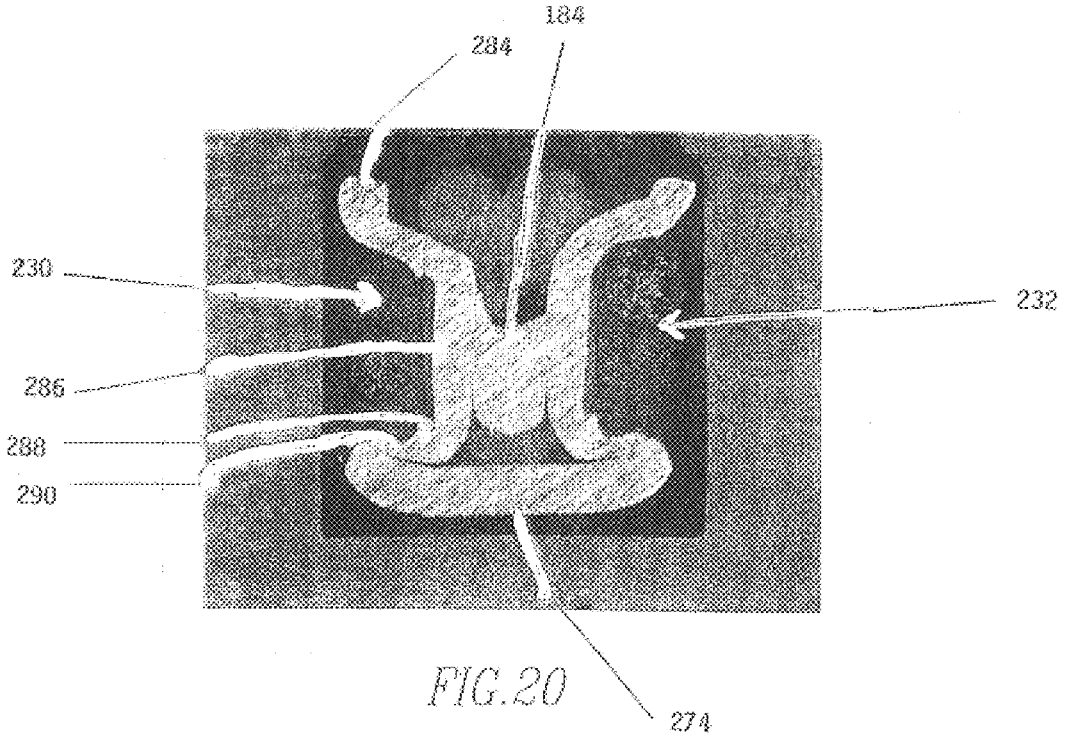
FIG. 20 is a magnified photograph showing a cross sectional view at a pair of opposed dimples of the present invention between which a wire is engaged.
Figure 21:
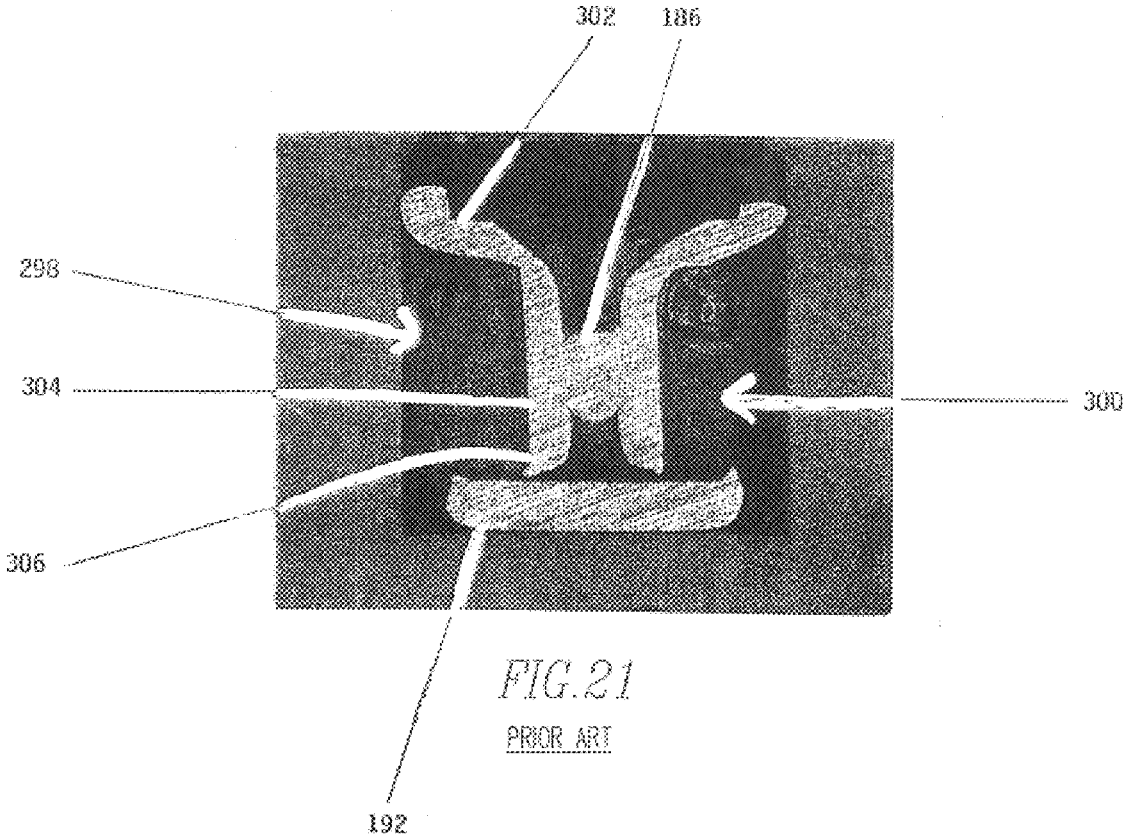
FIG.21 PRIOR ART
FIG. 21 is a magnified photograph showing a cross sectional view of a pair of opposed prior art sheared dimples between which a wire is engaged.

Referring to FIG. 20, further details of the contact dimple manufactured by this invention are illustrated. As is similar to the configuration shown in FIGS. 11–12, above the channel floor 274 there are opposed contact dimples 230 and 232. Each of these contact dimples has a top arm section as at 284, a medial section as at 286, a bottom section as at 288 and a lower arm section 290. Differences between the contact dimple of this invention and the prior art sheared dimple shown in FIG. 21 are apparent. A wire 184 is retained between these. Referring to FIG. 21, it will be seen that, similarly to FIGS. 11–13, the prior art sheared dimples 298 and 300 are positioned above a channel floor 192 and each have a top arm as at 302, a medial section as at 304 and a narrowed bottom section as at 306 but no lower floor section. A wire 186 is retained between these contacts.

Example and Test

1) Making the Terminals

Strip stock metal elements having a thickness of 0.008" and being a CDA52100 3/4 hard phorphor bronze alloy were processed in three sets of dies as described in the attached Table 1. A Brudener model BBV190/85 punch press was used under the following conditions: 450 strokes per minute with a 0.154" feed length. The channels formed by this process were used in an AT&T 963T2 connector. Eight 0.5 mm wire with 0.9 mm diameter semi-rigid PVC insulation were inserted in ten connectors at each of three different depth settings by means of an AT&T 1038A wire insertion machine, #5M1-377. The stuffer blade and wire depth gage used were as specified in AT&T X-20712 requirements. The machine was set for full insertion and gradually backed off the stuffer blade on each machine setting. Thus machine setting '1' specifies the deepest insertion and subsequent machine setting numbers are progressively higher in the insulation displacement contact (IDC) dimple. While there was no precise adjustment for depth on the machine used, an attempt was made to space the settings in 0.003" increments and all figures and tables in this example starting with a number refer to the machine setting number. All connector samples were numbered first by the machine setting number and then by order of insertion. All odd numbered samples for each machine setting were potted in epoxy so that they could be cross sectioned later to determine wire position and penetration of the wire by the IDC dimple of the connector contact.

2) Collection of Data

All physical measurements except for depth gage measurements performed on the samples were done on a toolmakers microscope. The depth gage used was made from a dial indicator, model B6K, fixtured to seat on the insulator as specified in X-20712. The contact spring rate was measured using INSTRON pull tester #BLN796835-A. For all even numbered connector samples for each machine setting, the inside width of the top of contact was measured with the wire inserted. The wire was then removed and the width was measured again. The elastic deflection at the top is thus the difference. All measurements were taken after the contact was first removed from the insulator. This data is listed in Tables 2, 3 and 4. All odd numbered connector samples for each machine setting were potted and ground to the middle of the first dimple. Wire height was calculated by measuring the distance to both the bottom and top of the wire from the inside bottom of the contact, adding the two measurements and dividing in half. The dimple opening was measured at the wire height. This data is listed in Tables 5, 6 and 7. Depth gage measurements were made after wire insertion as specified in the X-20712 requirements and are listed in Tables 5, 6 and 7. Depth gage readings were not taken for even numbered connectors. Electrical continuity between the wire and the connector contact was checked after wire insertion by inserting each end of a wire into two adjacent contacts and then probing the two contacts. To determine which of the two contacts was not making contact if an open occurred, the wire was cut between the two contacts and each contact and wire probed separately.

3) Calculated Data

Height to gage was considered to be the difference between the actual wire height measured and the height calculated from the wire depth gage reading. The height was calculated from the gage reading by subtracting the gage reading, half the outside diameter of the wire over the insulation and the metal thickness of the contact from the insulator channel depth. Connector contact elastic deflection at wire height is calculated from the average spring-back at the top of the contact for each machine setting. The calculated value was directly proportional to the height of the wire from the neutral axis in the bottom of the contact channel to the height of the top of the contact channel to this neutral axis. The normal area at the dimple (wire interface) in the area of the contact interface normal to the force applied by the contact we assume this area to be the intersection of two cylinders at right angles to each other. The depth of this intersection is determined from the measured dimple opening. A computer program was designed to integrate this area from the geometry involved. This method neglects any extra interface area created by extrusion of the wire in a direction perpendicular to the axis of the wire so the calculated area may under estimate the actual normal area. The spring rate of the connector contact near the top of the IDC channel was measured at 488 lbs/in on an Instron pull tester. The spring rate of unsupported terminals (no insulator housing) was calculated from an actual measured value at a given height in the channel and corrected for actual wire height using a ratio of calculated spring rates. The structural effect of drawing the dimples was to make the sides of the contact channel containing the dimples extremely stiff compared to the remaining part of the sides and the bottom of the channel. Thus in this area it was assumed the parts to be inelastic and prorated deflection of the contact at the wire height from the measured deflection at the top of the channel. Since both the contact deflection and wire height on the same sample could not be measured the averages from each sample for the calculations was used. The normal pressure for each machine setting is the normal force divided by the average normal area. All values stated are in pounds per square inch. The main calculated results for each machine setting are listed in Table 8.

4) Measured Results

Figure 22:
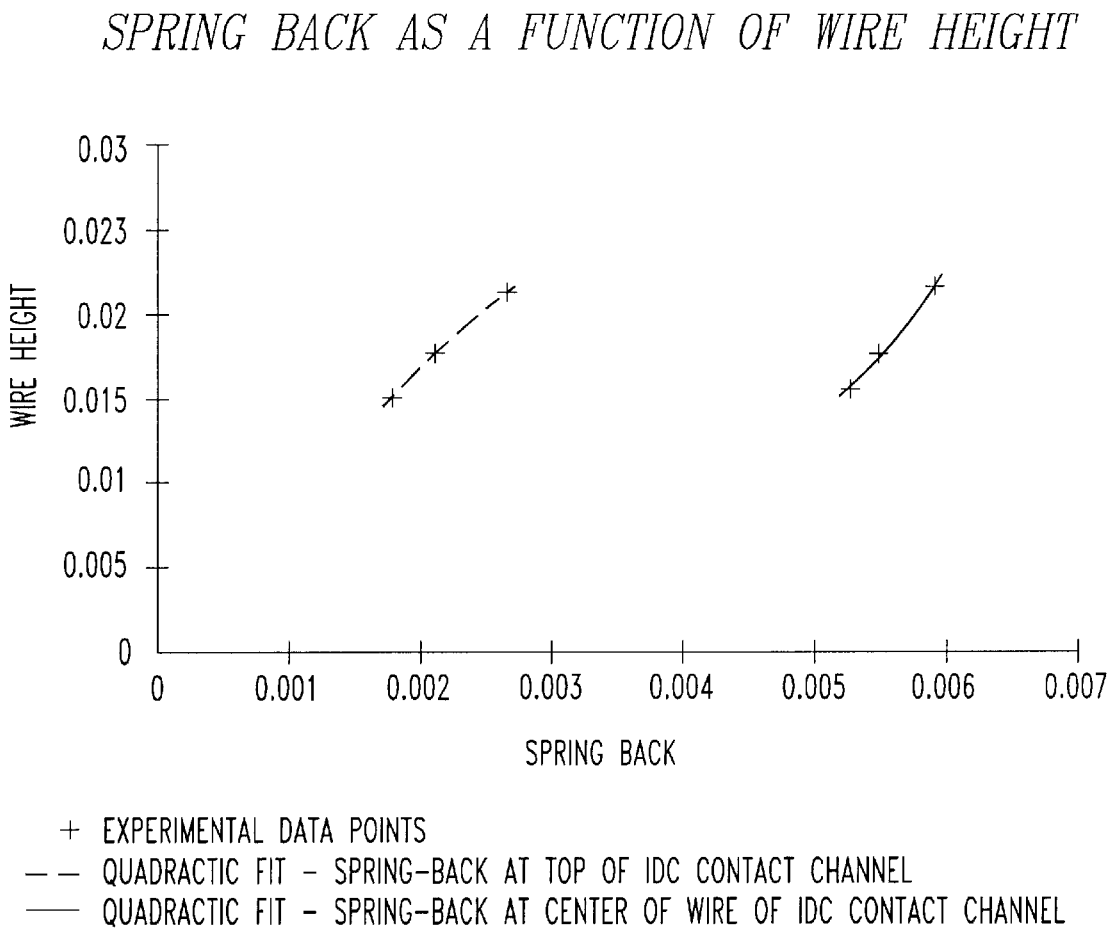
FIG. 22 is a graph showing spring-back as a function of wire height on tests performed with terminals manufactured according to a preferred embodiment of the present invention.
Figure 23:
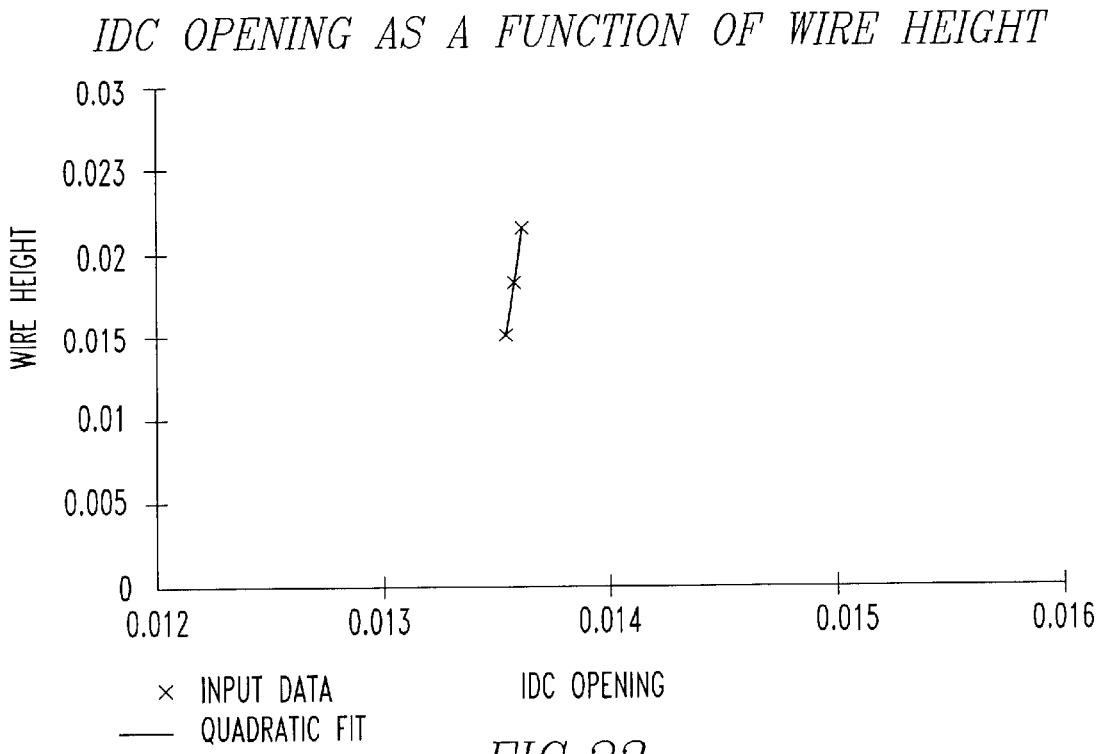
FIG. 23 is a graph showing insulation displacement opening as a function of wire height on tests performed with terminals manufactured according to a preferred embodiment of the present invention.
Figure 24:
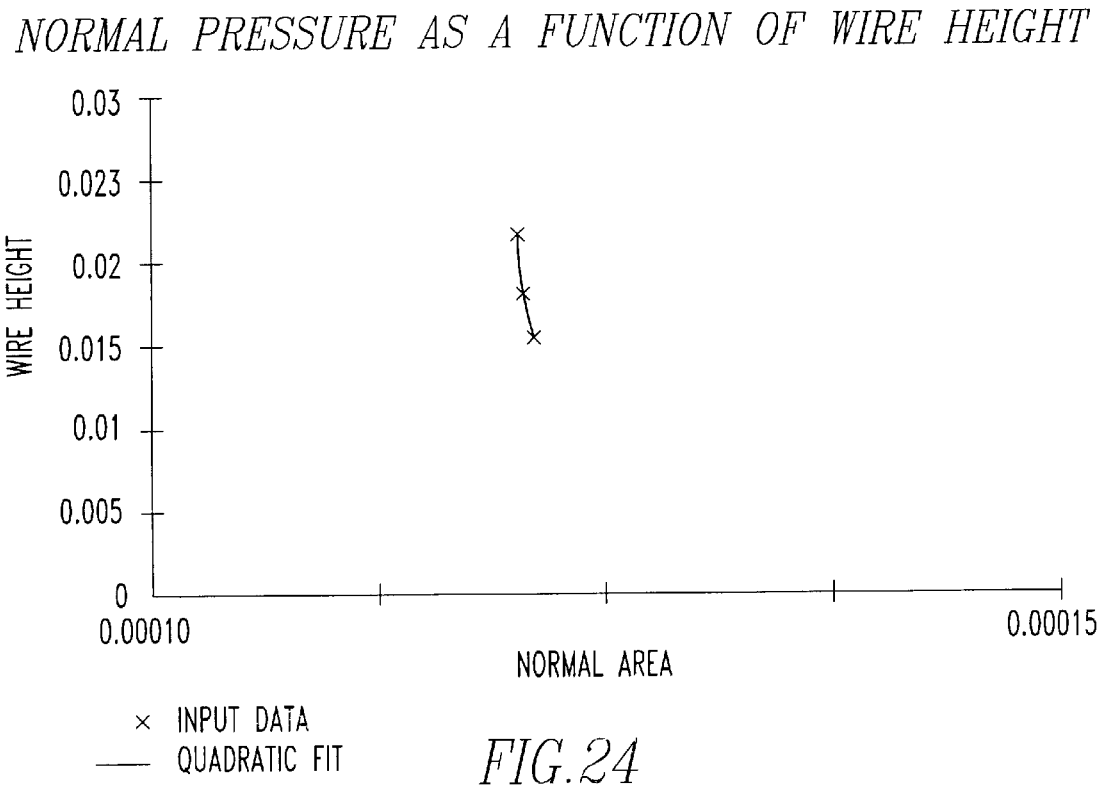
FIG. 24 is a graph showing normal area as a function of wire height on tests performed with manufactured according to a preferred embodiment of the present invention.
Figure 25:
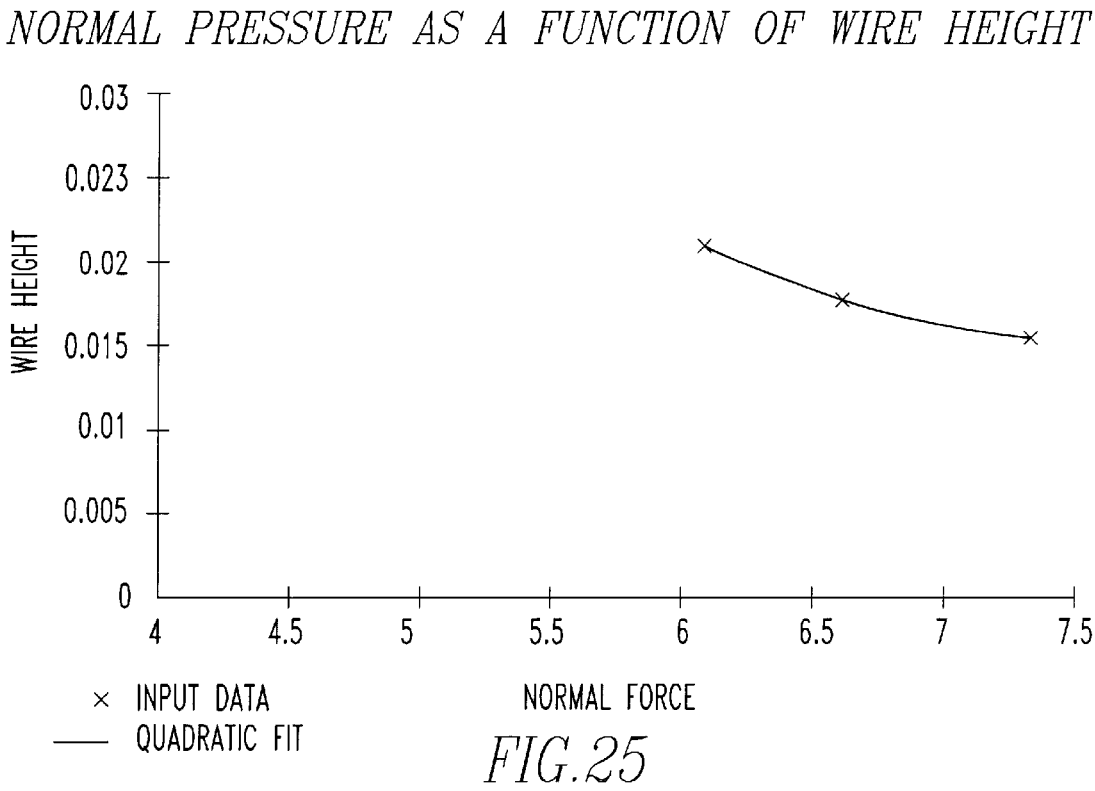
FIG. 25 is a graph showing normal force as a function of wire height on tests performed with manufactured according to a preferred embodiment of the present invention.
Figure 26:
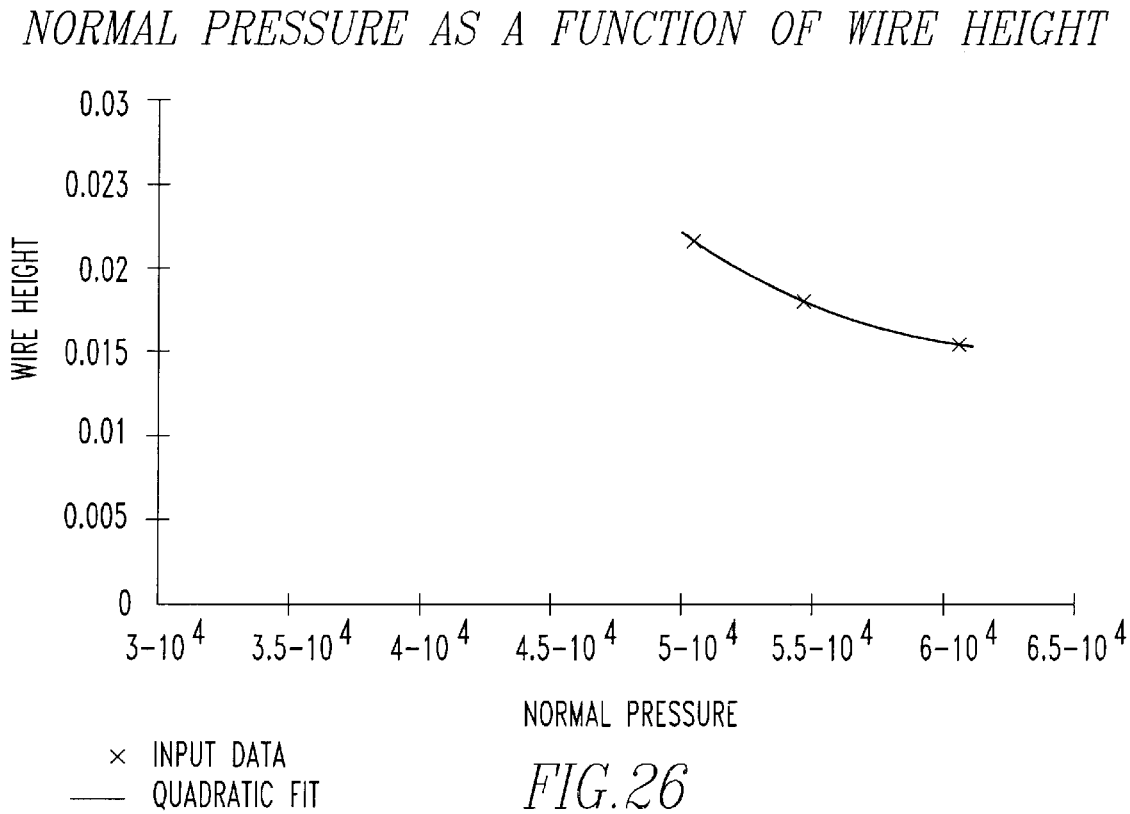
FIG. 26 is a graph showing normal pressure as a function of wire height on tests performed with manufactured according to a preferred embodiment of the present invention.

Original measurements indicated that there was electrical continuity between the wire and contact through all three machine settings. The spring-back of the contact as measured at the top of the contact channel is shown plotted versus wire height in FIG. 22 on the right side. The plot shows the spring-back measured at the top of the IDC contact channel decreases the further the wire is inserted in the contact. It was found that the contact does not spread against the insulator walls at the top. It was also found that the contacts with dimples do not require the support of the insulator needed by the sheared IDC dimples. The spring-back of the contact at the wire height is shown plotted versus wire height in FIG. 22 on the left side. The plot of IDC dimple opening versus the wire height is shown on FIG. 23. As shown in Tables 2, 3 and 4, the IDC dimple opening decreases at a very slow rate as the wire is inserted further. The normal area of contact between the wire and contact at the IDC dimple is shown plotted on FIG. 24. As the wire was inserted further into the IDC dimple the increase in normal area is slight. This was due to the slow change in the IDC dimple opening and to the initial heavy penetration of the wire by the IDC dimple. The plot of normal force versus wire height is shown on FIG. 24. It was found that a large increase in the force that is obtained with the swaged IDC dimples at any height which is believed to be due to both the increased elastic deflection of the contact and the increased spring rate. Due to the slight increase in normal area and the slightly larger increase in normal force as the wire is inserted further, normal pressure increases with wire depth. The results are plotted on FIG. 25. The actual average normal pressure may be somewhat smaller than calculated due to the area possibly being underestimated. As shown in the results listed in Tables 1A, 2A and 3A, the wire height calculated from the depth gage measurements have lower results by an average of 0.001" to 0.002" from the actual measured height. However the standard deviation was small. Thus wire height can be determined with reasonable accuracy for the wire tested here by applying a correction factor to the depth gage readings. The cross section of the inserted wire for machine settings 1 through 3 shows a variation of up to 0.002" in wire height along the length of the contact. This is apparently caused by the large insertion forces needed on this type IDC dimple. It was found that the top of the wire was at times flattened by the stuffer blade pressure and the insulation in this area has been pierced by the blade.

5) Conclusions

The data showed that the position of the wire that maximizes normal pressure on the contact is the deepest insertion possible. The actual minimum wire height (0.015) obtained by using the standard stuffer blade was less than half the diameter of the insulated wire (0.018). The insulated wire was pushed to the bottom of the channel at the IDC dimple slot compressing the insulation (0.003). AT&T Network Systems International (NSI) design guideline of 0.00079 inch/leg (20-um/leg) minimum spring-back of the IDC contact at the wire position over the entire insertion depth range were met. The maximum pressure on the wire at the IDC dimple was 60496 psi (417N/mm$^2$) when using the standard stuffer blade. Indicating an ability to meet NSI design guideline of 29,000 psi (200 N/mm$^2$) at all wire heights allowed in X-20712. The swaged IDC dimples resulted in a contact that does not depend on the strength of the connector insulator, results in a greater elastic range (spring-back), significantly increase the spring rate of the IDC channel and results in over twice the pressure on the wire at the IDC dimple for the gage of the wire tested.

Figure 27:
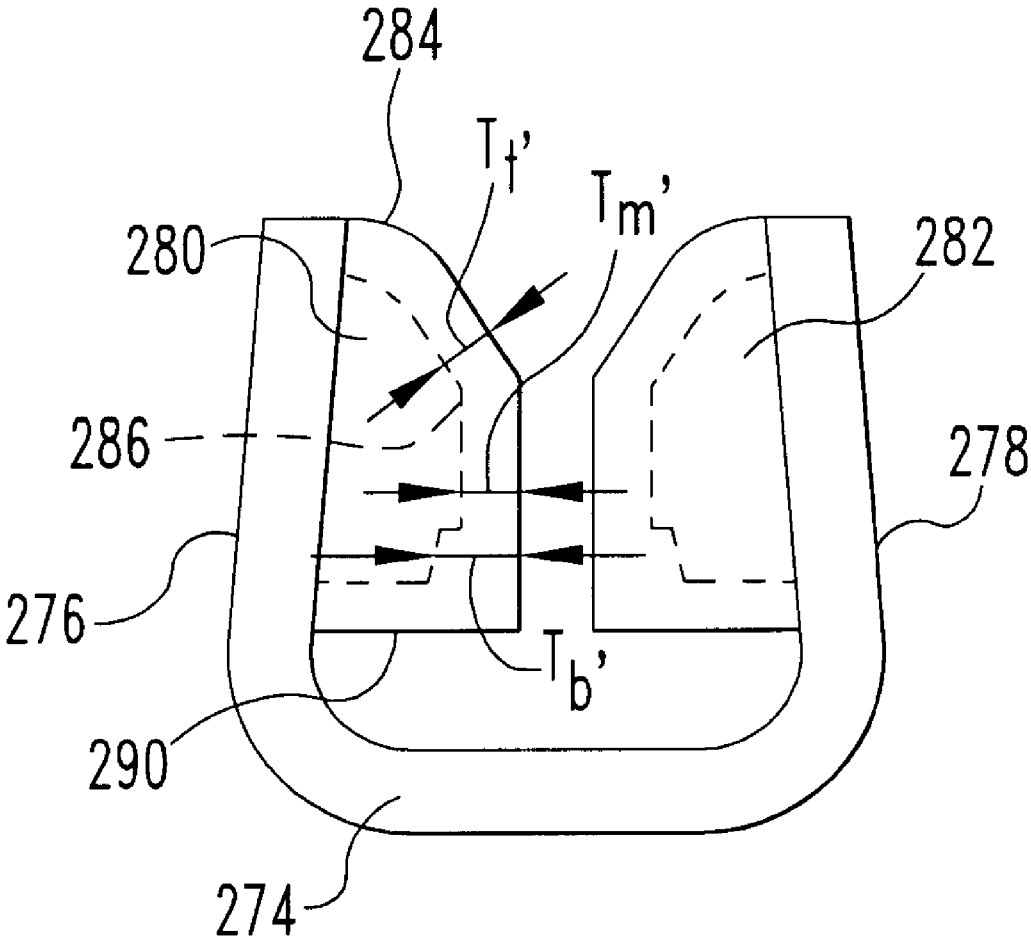
FIG. 27 is an end view similar to FIG. 11 showing another embodiment of the dimple of the present invention.

Referring to FIG. 27, another preferred embodiment of the insulation displacement contact of the present invention is shown. In this figure there is shown a contact channel with channel floor 274 and sidewalls 276 and 278. Contact dimples 280 and 282 extend from these sidewalls. Each of these contact dimples is spaced above the channel floor and has a top cover section as at 284, a medial section as at 286 and a bottom section as at 288. A lower floor section 290 extends from the sidewalls to contact the bottom section. The top section has thickness $t_t'$ which is preferably in the range of 0.002" to 0.008", the medial section has a thickness $t_m'$ which is preferably in the range of 0.002" to 0.008" and the bottom section has a thickness $t_b'$ which is preferably in the range of 0.002" to 0.008". It will be noted that the sidewalls 276 and 278 are canted slightly inwardly from the floor 274 to their upper edges. Those skilled in the art will appreciate that this arrangement may allow for efficiencies in cutting and removing insulation.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

TABLE 1

| | radius (in.) | slope (°) | height/depth (in.) |
|---|---|---|---|
| upper dies (identical) | .0050 | 50 | .0196 |
| first lower die | .0035 | 39 | .0160 |
| second lower die | .0050 | 56 | .0181 |
| third lower die | .0120 | 60 | .0185 |

TABLE 2

| DEPTH SETTING NUMBER = 1 | | | | | |
|---|---|---|---|---|---|
| CON- | | | CANNEL WIDTH | | |
| NECTOR NUMBER | CONTACT NUMBER | CONTIN-UITY | WITH WIRE | WIRE REMOVED | DELTA |
| 2 | 1 | Y | 0.0631 | 0.0571 | 0.0060 |
| | 2 | Y | 0.0635 | 0.0584 | 0.0051 |
| | 3 | Y | 0.0633 | 0.0583 | 0.0050 |
| | 4 | Y | 0.0632 | 0.0579 | 0.0053 |
| | 5 | Y | 0.0630 | 0.0576 | 0.0054 |
| | 6 | Y | 0.0621 | 0.0576 | 0.0045 |
| | 7 | Y | 0.0631 | 0.0578 | 0.0053 |
| | 8 | Y | 0.0629 | 0.0571 | 0.0058 |
| 4 | 1 | Y | 0.0628 | 0.0580 | 0.0048 |
| | 2 | Y | 0.0629 | 0.0573 | 0.0056 |
| | 3 | Y | 0.0623 | 0.0580 | 0.0043 |
| | 4 | Y | 0.0628 | 0.0574 | 0.0054 |
| | 5 | Y | 0.0631 | 0.0578 | 0.0053 |
| | 6 | Y | 0.0634 | 0.0579 | 0.0055 |
| | 7 | Y | 0.0627 | 0.0576 | 0.0051 |
| | 8 | Y | 0.0621 | 0.0563 | 0.0058 |
| 6 | 1 | Y | 0.0632 | 0.0582 | 0.0050 |
| | 2 | Y | 0.0633 | 0.0582 | 0.0051 |
| | 3 | Y | 0.0637 | 0.0582 | 0.0055 |
| | 4 | Y | 0.0634 | 0.0580 | 0.0054 |
| | 5 | Y | 0.0622 | 0.0579 | 0.0043 |
| | 6 | Y | 0.0636 | 0.0580 | 0.0056 |
| | 7 | Y | 0.0635 | 0.0581 | 0.0054 |
| | 8 | Y | 0.0628 | 0.0573 | 0.0055 |
| averages | | 1.00 | 0.06300 | 0.05775 | 0.00525 |
| std. dev. | | 0.00 | 0.00045 | 0.00047 | 0.00043 |

TABLE 3

| DEPTH SETTING NUMBER = 2 | | | | | |
|---|---|---|---|---|---|
| CON- | | | CANNEL WIDTH | | |
| NECTOR NUMBER | CONTACT NUMBER | CONTIN-UITY | WITH WIRE | WIRE REMOVED | DELTA |
| 2 | 1 | Y | 0.0629 | 0.0579 | 0.0050 |
| | 2 | Y | 0.0631 | 0.0579 | 0.0052 |
| | 3 | Y | 0.0633 | 0.0575 | 0.0058 |
| | 4 | Y | 0.0636 | 0.0582 | 0.0054 |
| | 5 | Y | 0.0633 | 0.0571 | 0.0062 |
| | 6 | Y | 0.0632 | 0.0576 | 0.0056 |
| | 7 | Y | 0.0623 | 0.0575 | 0.0048 |
| | 8 | Y | 0.0629 | 0.0569 | 0.0060 |
| 4 | 1 | Y | 0.0625 | 0.0577 | 0.0048 |
| | 2 | Y | 0.0632 | 0.0578 | 0.0054 |
| | 3 | Y | 0.0634 | 0.0577 | 0.0057 |
| | 4 | Y | 0.0637 | 0.0582 | 0.0055 |
| | 5 | Y | 0.0630 | 0.0578 | 0.0052 |
| | 6 | Y | 0.0633 | 0.0578 | 0.0055 |
| | 7 | Y | 0.0625 | 0.0575 | 0.0050 |
| | 8 | Y | 0.0626 | 0.0573 | 0.0053 |
| 6 | 1 | Y | 0.0627 | 0.0579 | 0.0048 |
| | 2 | Y | 0.0629 | 0.0581 | 0.0048 |
| | 3 | Y | 0.0633 | 0.0571 | 0.0062 |
| | 4 | Y | 0.0634 | 0.0576 | 0.0058 |
| | 5 | Y | 0.0629 | 0.0577 | 0.0052 |
| | 6 | Y | 0.0632 | 0.0573 | 0.0059 |
| | 7 | Y | 0.0629 | 0.0575 | 0.0054 |
| | 8 | Y | 0.0625 | 0.0568 | 0.0057 |
| averages | | 1.00 | 0.06302 | 0.05760 | 0.00542 |
| std. dev. | | 0.00 | 0.00036 | 0.00037 | 0.00042 |

TABLE 4

| DEPTH SETTING NUMBER = 3 | | | | | |
|---|---|---|---|---|---|
| CON- | | | CANNEL WIDTH | | |
| NECTOR NUMBER | CONTACT NUMBER | CONTIN-UITY | WITH WIRE | WIRE REMOVED | DELTA |
| 2 | 1 | Y | 0.0624 | 0.0576 | 0.0048 |
| | 2 | Y | 0.0644 | 0.0580 | 0.0064 |
| | 3 | Y | 0.0637 | 0.0575 | 0.0062 |
| | 4 | Y | 0.0635 | 0.0577 | 0.0058 |
| | 5 | Y | 0.0633 | 0.0577 | 0.0056 |
| | 6 | Y | 0.0647 | 0.0581 | 0.0066 |
| | 7 | Y | 0.0634 | 0.0576 | 0.0058 |
| | 8 | Y | 0.0629 | 0.0568 | 0.0061 |
| 4 | 1 | Y | 0.0637 | 0.0580 | 0.0057 |
| | 2 | Y | 0.0634 | 0.0575 | 0.0059 |
| | 3 | Y | 0.0641 | 0.0579 | 0.0062 |
| | 4 | Y | 0.0626 | 0.0578 | 0.0048 |
| | 5 | Y | 0.0639 | 0.0577 | 0.0062 |
| | 6 | Y | 0.0629 | 0.0570 | 0.0059 |
| | 7 | Y | 0.0628 | 0.0579 | 0.0049 |
| | 8 | Y | 0.0625 | 0.0569 | 0.0056 |
| 6 | 1 | Y | 0.0645 | 0.0583 | 0.0062 |
| | 2 | Y | 0.0644 | 0.0582 | 0.0062 |
| | 3 | Y | 0.0642 | 0.0582 | 0.0060 |
| | 4 | Y | 0.0642 | 0.0579 | 0.0063 |
| | 5 | Y | 0.0637 | 0.0579 | 0.0058 |
| | 6 | Y | 0.0638 | 0.0580 | 0.0058 |
| | 7 | Y | 0.0629 | 0.0569 | 0.0060 |
| | 8 | Y | 0.0633 | 0.0573 | 0.0060 |
| averages | | 1.00 | 0.06355 | 0.05768 | 0.00587 |
| std. dev. | | 0.00 | 0.00066 | 0.00042 | 0.00046 |

TABLE 5

| DEPTH SETTING NUMBER = 1 | | | | | | | |
|---|---|---|---|---|---|---|---|
| CONNECTOR NUMBER | CONTACT NUMBER | CONTI-NUITY | DEPTH GAGE | WIRE HEIGHT | HEIGHT TO GAGE | IDC OPENING | NORMAL AREA |
| 1 | 1 | Y | 0.0394 | 0.0156 | 0.0020 | 0.0131 | 0.000122 |
| | 2 | Y | 0.0391 | 0.0161 | 0.0022 | 0.0132 | 0.000120 |
| | 3 | Y | 0.0389 | 0.0145 | 0.0004 | 0.0133 | 0.000119 |
| | 4 | Y | 0.0388 | 0.0159 | 0.0017 | 0.0130 | 0.000124 |
| | 5 | Y | 0.0387 | 0.0142 | −.0001 | 0.0135 | 0.000115 |
| | 6 | Y | 0.0391 | 0.0142 | 0.0003 | 0.0135 | 0.000115 |
| | 7 | Y | 0.0390 | 0.0157 | 0.0017 | 0.0133 | 0.000119 |
| | 8 | Y | 0.0385 | 0.0158 | 0.0013 | 0.0128 | 0.000127 |
| 3 | 1 | Y | 0.0382 | 0.0145 | −.0003 | 0.0134 | 0.000117 |
| | 2 | Y | 0.0383 | 0.0159 | 0.0012 | 0.0133 | 0.000119 |
| | 3 | Y | 0.0386 | 0.0149 | 0.0005 | 0.0131 | 0.000122 |
| | 4 | Y | 0.0393 | 0.0148 | 0.0011 | 0.0132 | 0.000120 |
| | 5 | Y | 0.0386 | 0.0158 | 0.0014 | 0.0131 | 0.000122 |
| | 6 | Y | 0.0386 | 0.0156 | 0.0012 | 0.0132 | 0.000120 |
| | 7 | Y | 0.0382 | 0.0143 | −.0005 | 0.0132 | 0.000120 |
| | 8 | Y | 0.0391 | 0.0146 | 0.0007 | 0.0128 | 0.000127 |
| 5 | 1 | Y | 0.0389 | 0.0165 | 0.0024 | 0.0132 | 0.000120 |
| | 2 | Y | 0.0387 | 0.0164 | 0.0021 | 0 0132 | 0.000120 |
| | 3 | Y | 0.0375 | 0.0160 | 0.0005 | 0.0133 | 0.000119 |
| | 4 | Y | 0.0391 | 0.0163 | 0.0024 | 0.0133 | 0.000119 |
| | 5 | Y | 0.0397 | 0.0163 | 0.0030 | 0.0132 | 0.000120 |
| | 6 | Y | 0.0388 | 0.0160 | 0.0018 | 0.0132 | 0.000120 |
| | 7 | Y | 0.0389 | 0.0154 | 0.0013 | 0.0131 | 0.000122 |
| | 8 | Y | 0.0384 | 0.0154 | 0.0008 | 0 0127 | 0.000129 |
| averages | | | 0.03877 | 0.01545 | 0.00121 | 0.01317 | 0.0001209 |
| std. dev. | | | 0.00045 | 0.00073 | 0.00089 | 0.00019 | 0.0000033 |

TABLE 6

DEPTH SETTING NUMBER = 2

| CONNECTOR NUMBER | CONTACT NUMBER | CONTI-NUITY | DEPTH GAGE | WIRE HEIGHT | HEIGHT TO GAGE | IDC OPENING | NORMAL AREA |
|---|---|---|---|---|---|---|---|
| 1 | 1 | Y | 0.0380 | 0.0191 | 0.0041 | 0.0131 | 0.000122 |
| | 2 | Y | 0.0370 | 0.0170 | 0.0010 | 0.0134 | 0.000117 |
| | 3 | Y | 0.0364 | 0.0174 | 0.0008 | 0.0134 | 0.000117 |
| | 4 | Y | 0.0367 | 0.0174 | 0.0011 | 0.0136 | 0.000114 |
| | 5 | Y | 0.0362 | 0.0191 | 0.0023 | 0.0134 | 0.000117 |
| | 6 | Y | 0.0362 | 0.0171 | 0.0003 | 0.0133 | 0.000119 |
| | 7 | Y | 0.0370 | 0.0190 | 0.0030 | 0.0133 | 0.000119 |
| | 8 | Y | 0.0372 | 0.0175 | 0.0017 | 0.0131 | 0.000122 |
| 3 | 1 | Y | 0.0375 | 0.0177 | 0.0022 | 0.0130 | 0.000124 |
| | 2 | Y | 0.0367 | 0.0184 | 0.0021 | 0.0134 | 0.000117 |
| | 3 | Y | 0.0360 | 0.0185 | 0.0015 | 0.0132 | 0.000120 |
| | 4 | Y | 0.0364 | 0.0189 | 0.0023 | 0.0133 | 0.000119 |
| | 5 | Y | 0.0362 | 0.0171 | 0.0003 | 0.0134 | 0.000117 |
| | 6 | Y | 0.0375 | 0.0174 | 0.0019 | 0.0133 | 0.000119 |
| | 7 | Y | 0.0372 | 0.0189 | 0.0031 | 0.0133 | 0.000119 |
| | 8 | Y | 0.0376 | 0.0171 | 0.0017 | 0.0128 | 0.000127 |
| 5 | 1 | Y | 0.0373 | 0.0167 | 0.0010 | 0.0132 | 0.000120 |
| | 2 | Y | 0.0369 | 0.0182 | 0.0021 | 0.0130 | 0.000124 |
| | 3 | Y | 0.0368 | 0.0183 | 0.0021 | 0.0130 | 0.000124 |
| | 4 | Y | 0.0365 | 0.0174 | 0.0009 | 0.0130 | 0.000124 |
| | 5 | Y | 0.0369 | 0.0182 | 0.0021 | 0.0129 | 0.000126 |
| | 6 | Y | 0.0373 | 0.0173 | 0.0016 | 0.0130 | 0.000124 |
| | 7 | Y | 0.0372 | 0.0184 | 0.0026 | 0.0132 | 0.000120 |
| | 8 | Y | 0.0370 | 0.0181 | 0.0021 | 0.0130 | 0 000124 |
| averages | | | 0.03690 | 0.01793 | 0.00183 | 0.01319 | 0.0001206 |
| std. dev. | | | 0.00050 | 0.00074 | 0.00088 | 0.00020 | 0.0000033 |

TABLE 7

DEPTH SETTING NUMBER = 3

| CONNECTOR NUMBER | CONTACT NUMBER | CONTI-NUITY | DEPTH GAGE | WIRE HEIGHT | HEIGHT TO GAGE | IDC OPENING | NORMAL AREA |
|---|---|---|---|---|---|---|---|
| 1 | 1 | Y | 0.0339 | 0.0222 | 0.0031 | 0.0131 | 0.000122 |
| | 2 | Y | 0.0342 | 0.0214 | 0.0026 | 0.0130 | 0.000124 |
| | 3 | Y | 0.0346 | 0.0206 | 0.0022 | 0.0128 | 0.000127 |
| | 4 | Y | 0.0348 | 0.0203 | 0.0021 | 0.0129 | 0.000126 |
| | 5 | Y | 0.0339 | 0.0213 | 0.0022 | 0.0131 | 0.000122 |
| | 6 | Y | 0.0340 | 0.0202 | 0.0012 | 0.0130 | 0.000124 |
| | 7 | Y | 0.0341 | 0.0201 | 0.0012 | 0.0133 | 0.000119 |
| | 8 | Y | 0.0337 | 0.0219 | 0.0026 | 0.0129 | 0.000126 |
| 3 | 1 | Y | 0.0340 | 0.0228 | 0.0038 | 0.0132 | 0.000120 |
| | 2 | Y | 0.0341 | 0.0208 | 0.0019 | 0.0134 | 0.000117 |
| | 3 | Y | 0.0337 | 0.0203 | 0.0010 | 0.0134 | 0.000117 |
| | 4 | Y | 0.0334 | 0.0229 | 0.0033 | 0.0133 | 0.000119 |
| | 5 | Y | 0.0335 | 0.0225 | 0.0030 | 0.0134 | 0.000117 |
| | 6 | Y | 0.0332 | 0.0233 | 0.0035 | 0.0134 | 0.000117 |
| | 7 | Y | 0.0334 | 0.0234 | 0.0038 | 0.0131 | 0.000122 |
| | 8 | Y | 0.0344 | 0.0213 | 0.0027 | 0.0131 | 0.000122 |
| 5 | 1 | Y | 0.0336 | 0.0220 | 0.0026 | 0.0139 | 0.000109 |
| | 2 | Y | 0.0342 | 0.0213 | 0.0025 | 0.0137 | 0.000112 |
| | 3 | Y | 0.0336 | 0.0217 | 0.0023 | 0.0130 | 0.000124 |
| | 4 | Y | 0.0341 | 0.0205 | 0.0016 | 0.0132 | 0.000120 |
| | 5 | Y | 0.0341 | 0.0218 | 0.0029 | 0.0132 | 0.000120 |
| | 6 | Y | 0.0339 | 0.0205 | 0.0014 | 0.0131 | 0.000122 |
| | 7 | Y | 0.0341 | 0.0204 | 0.0015 | 0.0134 | 0.000117 |
| | 8 | Y | 0.0350 | 0.0200 | 0.0020 | 0.0131 | 0.000122 |
| averages | | | 0.03398 | 0.02140 | 0.00237 | 0.01321 | 0.0001203 |
| std. dev. | | | 0.00043 | 0.00103 | 0.00079 | 0.00025 | 0.0000042 |

TABLE 8

FORCE AND PRESSURE AT IDC DIMPLE ON INSERTED WIRE

| MACHINE SETTING | SPRING BACK AT TOP (inches) | SPRING BACK AT WIRE (inches) | WIRE HEIGHT (inches) | IDC DIMPLE OPENING (inches) | NORMAL AREA (inches) | NORMAL FORCE (lbs) | NORMAL PRESSURE (lbs/in-sq) |
|---|---|---|---|---|---|---|---|
| 1 | 0.00525 | 0.00179 | 0.01545 | 0.01317 | 0.0001209 | 7.3075 | 60496 |
| 2 | 0.00542 | 0.00208 | 0.01793 | 0.01319 | 0.0001206 | 6.6008 | 54760 |
| 3 | 0.00587 | 0.00262 | 0.02140 | 0.01321 | 0.0001203 | 6.0864 | 50623 |

What is claimed is:

1. A method for manufacturing an insulation displacement contact dimple comprising the steps of:

(a) positioning a metal element between a first concave die and a first convex die having a radius to form a dimple shape in the metal element;

(b) positioning the dimple shaped metal element in step (a) between a second concave die and a second convex die having a radius smaller than the first convex die to form the metal element in the dimple shape having a greater height than the dimple formed in step (a); and (c) positioning the dimple shaped element found in step (b) between a third concave die and a third convex lower die having a radius larger than the radius of the second die.

2. The method for manufacturing an insulation displacement contact dimple of claim 1 wherein in step (a) the metal is stretched.

3. The method for manufacturing an insulation displacement contact dimple of claim 2 wherein in step (a) the metal is compressed along the side of the dimple shaped element.

4. The method for manufacturing an insulation displacement contact dimple of claim 3 in step (a) the metal is swaged.

5. The method for manufacturing an insulation displacement contact dimple of claim 1 wherein in step (a) there is a first cavity between the dimple shaped element and the first die and metal is extruded upwardly towards said first cavity.

6. The method for manufacturing an insulation displacement contact dimple of claim 1 wherein in step (b) the metal is compressed along the side of the dimple shaped element.

7. The method for manufacturing an insulative displacement contact dimple of claim 6 wherein in step (b) the metal is swaged.

8. The method for manufacturing an insulation displacement contact dimple of claim 6 wherein there is a base of the dimple shaped element and in step (a) metal is compressed at a first height above the base and in step (b) the metal is compressed at a second height above the base and said second height is greater than said first height.

9. The method for manufacturing an insulation displacement contact dimple of claim 8 wherein in step (b) there is a second cavity between the concave die and the dimple shaped element and metal is caused to flow toward said second cavity in step (b).

10. The method for manufacturing an insulation displacement contact dimple of claim 9 wherein there are lateral cavities between the second convex die and the dimple shaped element.

11. The method for manufacturing an insulation displacement contact dimple of claim 1 wherein in step (c) the third convex die has a steeper slope than the second convex die.

12. The method for manufacturing an insulation displacement contact dimple of claim 11 wherein there is a third cavity between the dimple shaped element and the third concave die.

13. The method for manufacturing an insulation displacement contact dimple of claim 12 wherein there is a cavity between the element and the third die.

14. The method for manufacturing an insulation displacement contact dimple of claim 13 wherein in step (c) metal is caused to flow into the third concave die.

15. The method for manufacturing an insulation displacement contact dimple of claim 14 wherein in step (c) metal is caused to flow into the cavity.

16. The method for manufacturing an insulation displacement contact dimple of claim 15 wherein in step (c) metal is caused to flow into the cavity before metal is caused to flow into the third cavity.

17. The method for manufacturing an insulation displacement contact dimple of claim 16 wherein said dimple has a top, bottom and medial section and the metal has a thickness and the thickness in the top and bottom sections is greater than the thickness in the medial section.

18. The method for manufacturing an insulation displacement contact dimple of claim 17 wherein some metal is caused to flow into the third cavity while metal is still being caused to flow into the cavity.

19. The method for manufacturing an insulation displacement contact dimple of claim 18 wherein the third convex die has a radius and said radius is smaller than the thickness of the metal.

20. The method of claim 19 wherein the thickness of the metal in the dimple in the top section is from about 0.002" to about 0.008", the thickness of the dimple in the bottom section is from about 0.002" to about 0.008" and the thickness of the dimple in the medial section is from about 0.002" to about 0.008".

21. The method of claim 1 wherein the radius of the first convex die is from about 0.003" to about 0.005", the radius of the second convex die is from about 0.004" to about 0.006", and the radius of the third convex die is from about 0.010" to about 0.015".

22. The method of claim 1 wherein the slope of the first lower die is from about 30° to about 40°, the slope of the second lower die is from about 40° to about 50° and the slope of the third lower die is from about 50° to about 60°.

23. The method of claim 1 wherein the metal element initially positioned between the first concave die and the first convex die in step (a) has a thickness of between about 0.005" and about 0.020".

24. The method of claim I wherein the metal element initially positioned between the first concave die and the second concave die in step (a) is an alloy selected from a group consisting of a copper alloy and a spring steel.

25. The method of claim 1 wherein the first concave die, the second concave die and the third concave die are identical.

26. A method for manufacturing an insulation displacement contact dimple comprising the steps of:

(a) providing an insulation displacement contact;

(b) positioning said insulation displacement contact between a first concave die and a first convex die having a radius to form a dimple having a height;

(c) positioning said dimple between a second concave die and a second convex die having a radius larger than said radius of said first convex die to increase said height of said dimple.

27. The method as recited in claim 26, wherein the insulation displacement contact providing step includes positioning said insulation displacement contact between a third concave die and a third convex die having a radius larger than said radius of said first convex die before step (b) to form said dimple having a height less than said height formed in step (b).

28. In a method of manufacturing an insulation displacement contact having a dimple thereon, wherein the improvement comprises creating said dimple in a plurality of metal forming steps.

* * * * *